United States Patent [19]

Gilanyi

[11] Patent Number: 4,687,401

[45] Date of Patent: Aug. 18, 1987

[54] PIPE POSITIONER

[75] Inventor: Frank Gilanyi, South Milwaukee, Wis.

[73] Assignee: Becor Western Inc., South Milwaukee, Wis.

[21] Appl. No.: 782,046

[22] Filed: Sep. 30, 1985

[51] Int. Cl.[4] ..... E21B 19/14

[52] U.S. Cl. ..... 414/22; 175/85; 294/88; 294/119.1; 414/741

[58] Field of Search ..... 414/22, 741; 294/88, 294/119.1; 175/85; 901/37, 39

[56] References Cited

U.S. PATENT DOCUMENTS

| | | | |
|---|---|---|---|
| Re. 30,071 | 8/1979 | Hilding et al. | 414/22 X |
| 2,245,938 | 6/1941 | Ratigan | 294/90 |
| 2,692,059 | 10/1954 | Bolling | 175/85 X |
| 2,828,024 | 3/1958 | True | 414/22 |
| 3,322,456 | 5/1967 | Strakhal et al. | 294/88 |
| 3,613,906 | 10/1971 | Deyo et al. | 414/22 |
| 3,773,188 | 11/1973 | Arrington | 294/88 X |
| 4,403,897 | 9/1983 | Willis | 294/119.1 X |

OTHER PUBLICATIONS

Japanese PCT Publication No. WO 84/04778; published Dec. 6, 1984.

*Primary Examiner*—Leslie J. Paperner
*Attorney, Agent, or Firm*—Quarles & Brady

[57] ABSTRACT

A pipe positioner for holding an end of a drill pipe in an earth drilling machine which is especially suited for use during blast hole drilling. The pipe positioner is connected to the mast of the earth drilling machine in a tubular guide frame arrangement which will allow movement of the pipe positioner inwardly and outwardly with respect to the mast. The pipe positioner includes jaws provided by slide bar members positioned in the guide frame of the pipe positioner. A double acting hydraulic cylinder connected to a pivoted linkage moves the slide bars to engage or disengage the pipe. In a preferred manner, the frame member for the jaws is provided by telescoping tubular members and the mast is of the tilting type for angle drilling.

5 Claims, 8 Drawing Figures

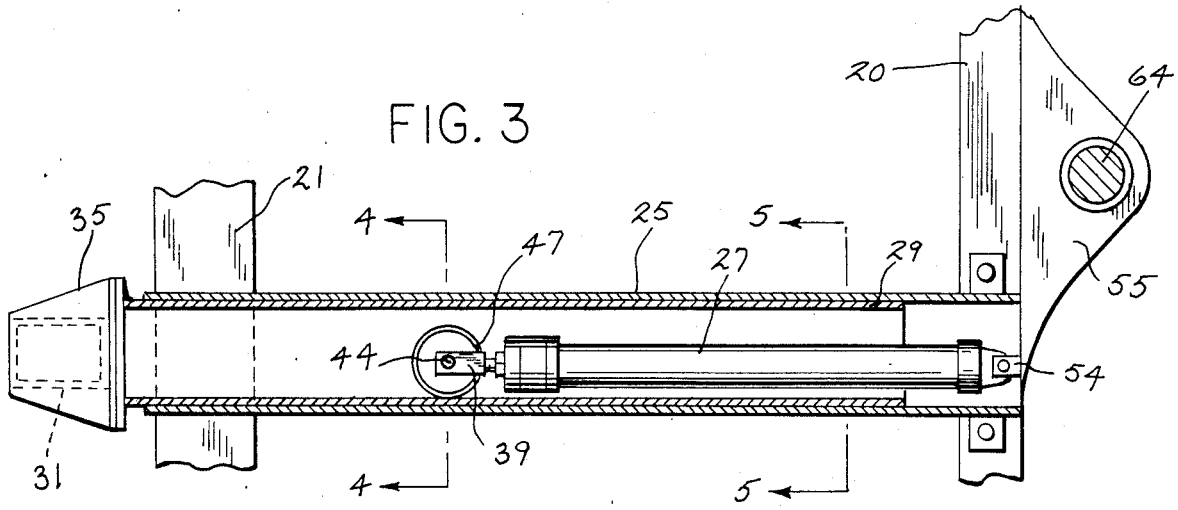
FIG. 3
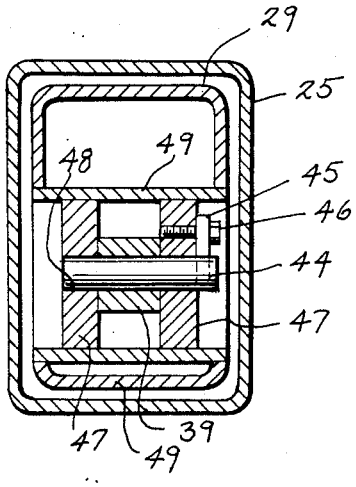
FIG. 4
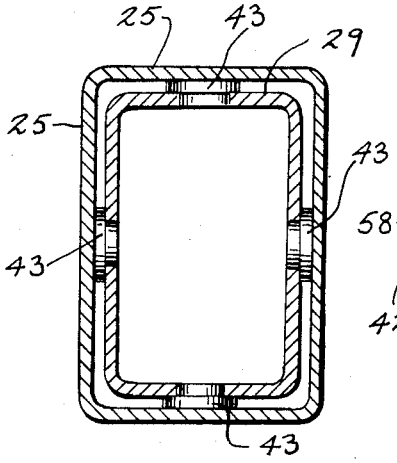
FIG. 5
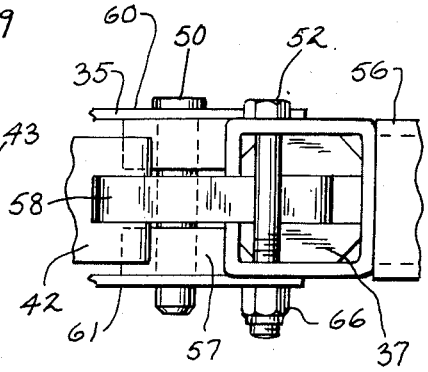
FIG. 7
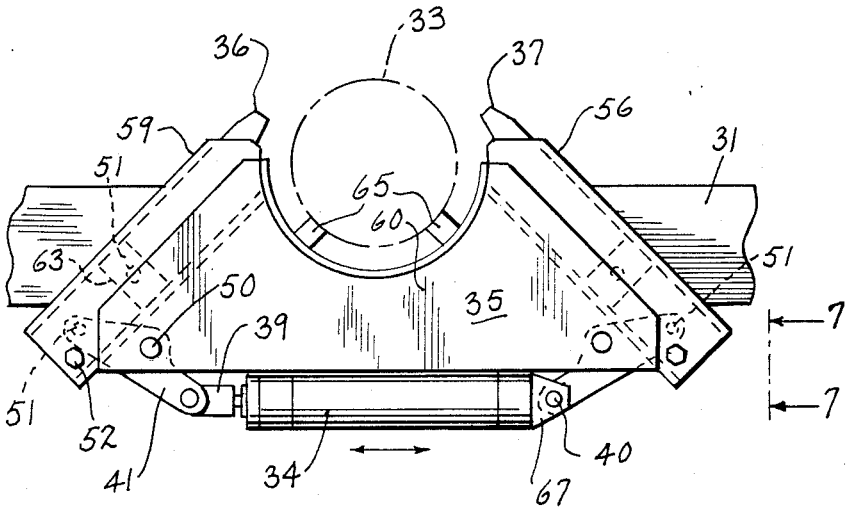
FIG. 6
FIG. 8
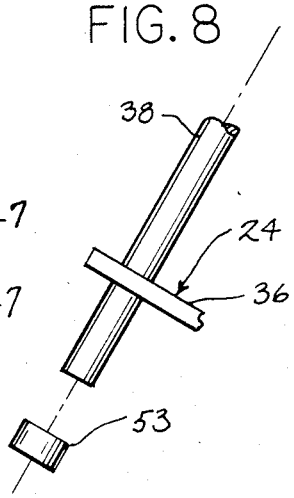

PIPE POSITIONER

BACKGROUND OF THE INVENTION

This invention relates to a pipe positioner for aligning drill pipes during drilling while joints are assembled or disassembled. More particularly, this invention relates to a pipe positioner which is especially suited for holding the pipe during angle drilling wherein the pipe positioner telescopes in a linear manner inwardly and outwardly from the mast and has slidable jaw members for engaging the drill pipe that are activated by a single hydraulicl cylinder.

It is known in Hilding, et al., U.S. Pat. No. Re 30,071 to utilize roller members 74–77 which can be actuated by double acting hydraulic cylinders 78 and 79 for gripping drill rod 25. This patent also discloses pivoting arms such as 101, 102, 105 and 106 to provide the suitable actuating linkages. The unit therein described is a tonglike device to be used in conjunction with transferring arms 26 and a spinning device 27 for aligning the drill rods in a drill string. In the Gyongyosi U.S. Pat. No. 3,493,061 a particular indexing apparatus in the form of a wheel 71 is disclosed in conjunction with the drill pipe rack 30 to act as an alignment device. A cut out 73 is employed to engage the upper end of the existing drill string to assure proper alignment. In the Lindstedt U.S. Pat. No. 4,455,116 a particular type of clamping arrangement for drill pipe in a blast hole drill is disclosed such as the upper and lower type clamps 41–44 to be opened and closed by means of a rotating clamp rod 46. The clamp rod is rotated by a hydraulic cylinder 103. All of the foreoing prior art units employ a rotary motion to position the drill rods or pipe with respect to the frame structure of the mast.

The prior art does not provide a pipe positioner which is especially suited for engaging drill pipes during an angle drilling operation. The prior art apparatus utilizes pivoting arm devices which are pivoted outwardly or inwardly from the mast. In addition, the prior art units are multiple component devices which are not susceptible to being easily controlled.

This pivotal motion is undesirable for a pipe engaging member utilized in angle drilling when the loose end of a drill pipe is free to move to a perpendicular position with respect to the ground surface and away from the angled mast. It will be appreciated that to position the pipe in an angled manner with respect to the mast deck, a linear motion is preferred over a resulting arcuate one which would be imparted by the prior art units.

It is an advantage of the present invention to provide a pipe positioner which is especially suited for holding pipes during an angle drilling operation with a blast hole drill.

It is another advantage of the invention to provide a pipe positioner having a movable frame structure and jaw members which are easily controlled.

It is yet another advantage of the invention to provide a pipe positioner of the foregoing type which is movable linearly into and out of a mast in a telescoping frame structure.

Another advantage of this invention is a pipe positioner which not only will move linearly in and out of a blast hole drill mast but which has jaw members which can be activated by a double acting hydraulic cylinder.

Other advantages are a pipe positioner of the foregoing type which is inexpensive to produce and is of a relatively small size affording the operator a maximum view of a drilling operation.

The foregoing advantages are accomplished and the short-comings of the prior art are overcome by the pipe positioner of this invention for holding drill pipe in an earth drilling machine such as blast hole drills and which is particularly suitable for use in angle hole drilling. A frame member is adapted to support a jaw engaging means for the drill pipe. A frame member activating means is connected to the mast of the earth drilling machine. The frame member activating means is constructed and arranged to provide a linear inward and outward movement of the frame member with respect to the mast. Means are provided to move the jaw engaging means from a pipe engaging position to a non-engaging position. The frame member activating means moves the frame member inwardly and outwardly with respect to the mast and in a telescoping manner. In a preferred manner, the jaw engaging means are defined by slide bar members operatively positioned in a guide frame member. The guide frame member is of a generally triangular configuration and includes guide surfaces for moving the slide bars to guide the bar members in a converging guide path. Also preferrably, the means to move the jaw engaging means is a double acting hydraulic cylinder and includes pivoted linkage means operatively connected to the cylinder and the bar members. Additionally, the means to move the frame members inwardly and outwardly from the mast are provided by hydraulic cylinder means disposed in the frame member and frame support members; and the mast to which the frame member and the frame supporting means are connected is of the tilting type.

BRIEF DESCRIPTION OF THE DRAWINGS

A better understanding of the pipe positioner of this invention will be accomplished by reference to the drawings wherein:

FIG. 3 is a view in vertical section taken along line 3—3 of FIG. 2.

FIG. 4 is a view in vertical section taken along line 4—4 of FIG. 3.

FIG. 5 is a view in vertical section taken along-5—5 of FIG. 3.

FIG. 6 is an enlarged top plan view of the jaw engaging means and the means for actuation.

FIG. 7 is a view in vertical section taken along line 7—7 of FIG. 6.

FIG. 8 is a partial schematic view illustrating the positioning of the drill pipe by the pipe positioner and with respect to the mast deck.

DESCRIPTION OF THE PREFERRED EMBODIMENT

Figure 1:
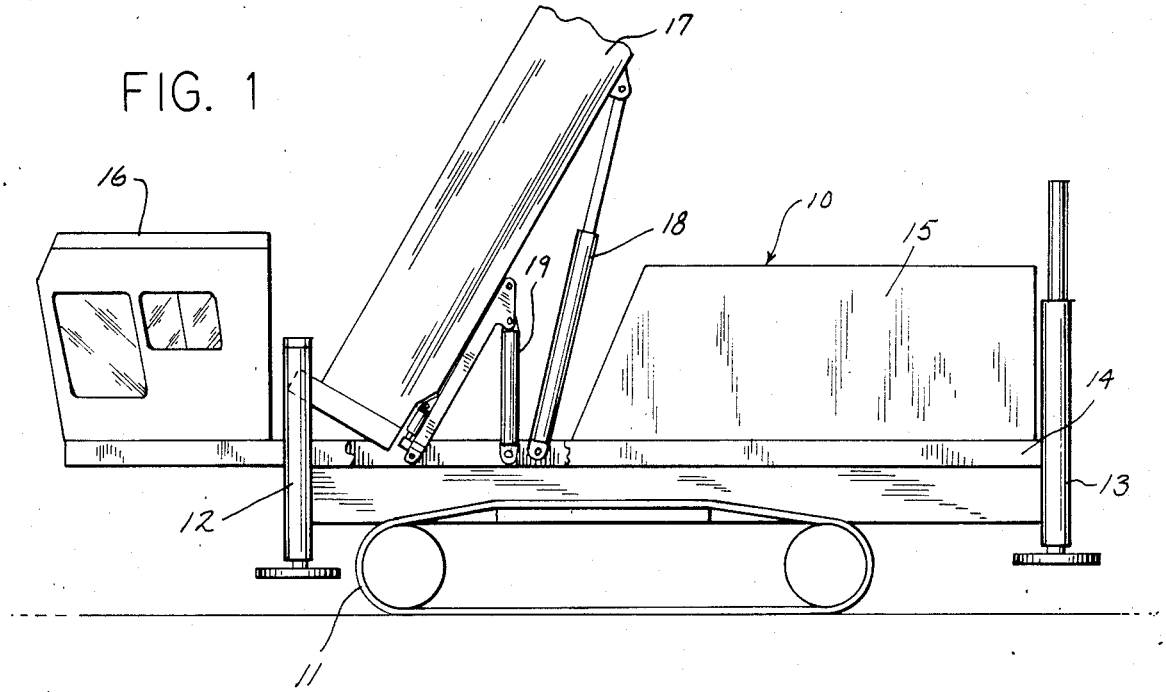
FIG. 1 is the partial side view of a blast hole drill incorporating the pipe positioner of this invention.

A blast hole drill is shown in FIG. 1 with which the pipe positioner assembly generally 24 (See FIG. 2) is to be employed. The blast hole drill is dessignated by the reference numeral generally 10 and will include the usual crawler vehicle 11 by which it may be moved from location to location. It is supported in a working position and raised and lowered to this position by four double acting hydraulic jacks with one of the rear jacks shown at 12 and one of the front jacks shown at 13. The jacks 12 and 13 are mounted on the main frame 14 which is supported on the crawler and serves as a platform for the drill mast 17. The drill mast is raised and lowered as well as placed in an angled position by the hydraulic cylinder 18 and the telescoping strut 19. Also supported on the main frame 14 is the operator's cab 16 and the housing 15 for operating machinery.

Figure 2:
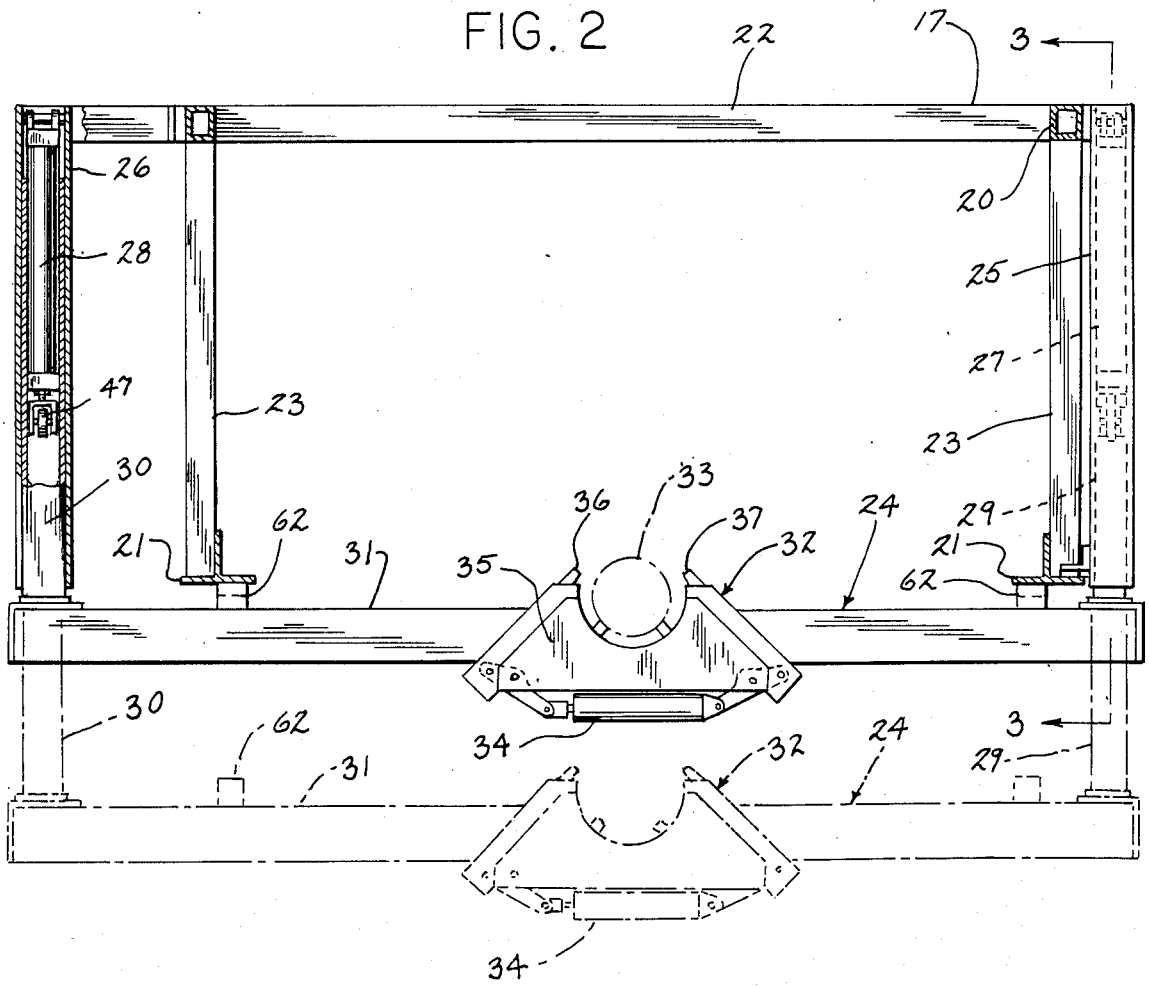
FIG. 2 is a top plan view and partially in horizontal section illustrating the pipe positioner in solid lines for positioning pipe over the mast guide hole and in phantom lines for storage prior to engaging the drill pipe for alignment over the guide hole.

Referring specifically to FIG. 2, the pipe positioner generally 24 is supported for linear motion inwardly and outwardly from the mast 17. It includes the tubular frame members 25 and 26 mounted on the mast to provide in part a frame member activating means for a frame member including the slidable arms 29 and 30 which telescope with respect to the tubular members 25 and 26 and is interconnected by the crossarm 31. The crossarm 31 will support the jaw engaging means generally 32. The mast includes the usual frame structure composed of the vertical supports 20 and 21 as well as the cross members 22 and 23.

As best seen in FIGS. 2 and 3, the hydraulic cylinders 27 and 28 are connected to the mast 17 at one end and to the slidable arms 29 and 30 at the other. The hydraulic cylinders 27 and 28 also form a part of the frame member activating means and are positioned inside the inner slidable arms 29 and 30. This is best seen in FIG. 3 with respect to hydraulic cylinder 27 positioned inside tubular slidable arm 29. It will be further seen that hydraulic cylinder 27 is connected to the mast by the pivoted bracket 54. The mast 17 is tiltable in part by the mast pivot bar 64 mounted in the flange 55.

The connection of the cylinders 27 and 28 to the slidable arms 29 and 30 is indicated in FIG. 4. As seen therein, crossarms 49 are disposed in the slidable arm 29 and in turn to rounded arms 47 which are connected in a transverse manner with respect to the crossarms 49. The arms 47 have a passage 48 to receive the pin 44 as well as the clevis 39 of the hydraulic cylinder 27. Clevis 39 is thereby pivotably connected between the arms 47. Pin 44 is retained in a stationary manner with respect to the arms 47 by the pin 45 which engages the pin 44 and is retained in a nonrotatable manner with respect to the arms 47 by the screw 46.

As indicated in FIG. 5, the inner slidable arm 29 is guided in the tubular member 25 by the guides 43. The guides are preferably positioned at 90 degrees with respect to the rectangular frame structure. The slidable arm 30 is also guided by the guides 43 with respect to the tubular member 26.

FIGS. 6 and 7 show the actuating mechanism for moving the jaws 36 and 37 in the jaw housings 56 and 59 which are connected to the frame 35. Referring specifically to FIG. 6, a double acting cylinder 34 is interconnected to the pivot arms 41 and 42. It should be noted that the cylinder 34 is not connected to the frame 35 but is free to act in conjunction with the pivot arms 41 and 42. Pivot arm 41 is pivotally connected to the reciprocating clevis member 39 and pivot arm 42 is pivotally connected to the fixed bracket 67 of the cylinder 34. As indicated, the pivot arms 41 and 42 are pivotally mounted in the frame 35 by the pivot pins 50. The frame 35 has the spaced apart plate members 60 and 61. (See FIG. 7) The pivot arms 41 and 42 are in turn pivotally attached to the slidable jaws 36 and 37 by the bar link 58 and the pivot pins 51. As shown in FIG. 6 the jaws 36 and 37 are in the retracted position. The base of jaw 36 is indicated by the numeral 63 to indicate the extended position.

A better understanding of the advantages of the pipe positioner 24 will be had by a description of its operation.

OPERATION

During the drilling operation of a blast hole, it often becomes necessary to position the drill pipe at an angle with respect to the earth's surface. This becomes a problem in that once the usual drilling mechanism is suitably connected to the upper end of the drill pipe, the mast is tilted at an angle. The loose bottom end of the drill pipe will seek to assume a position perpendicular to the earth's surface. In order to align the drill pipe with the mast bushing, the drill pipe positioner 24 is utilized advantageously. This is illustrated in FIG. 8 where it will be seen that the drill pipe 38, is engaged with the pipe positioner 24 to align it with respect to the mast deck bushing 53. The drill pipe will be suitably orientated initially with the blast guide hole 33 by a suitable pipe rack apparatus such as described in an application entitled "Dual Drill Pipe Rack" Ser. No. 781,720 filed Sept. 30, 1985 and assigned to the assignee of this application.

It will be appreciated that the pipe positioner 24 is shown in phantom lines in FIG. 2 away from the mast 17. This is the stored position.

In order to position the pipe positioner with respect to the drill pipe, the cylinders 27 and 28 are activated to move the slidable arms 29 and 30 inwardly with respect to the mast 17. This positions the open jaw members 36 and 37 adjacent the free end of the drill pipe. As the cross-arm 31 with the stops 62 engage appropriate switches (not shown) on the cross members 23 the cylinder 34 is activated. This activation causes the clevis 39 to move outwardly thereby effecting a clockwise pivoting of the pivot arm 41 and a movement of the jaw 36 outwardly from the housing 59. This movement continues until the jaw 36 engages the drill pipe 38. Continued resistance of further movement is effected which in turn causes the cylinder 34 to move axially in a direction toward jaw 37. This motion is translated to the bell crank-like pivot arm 42 to also effect a counterclockwise movement and an extension of the jaw 37 to engage the drill pipe. The drill pipe when engaged by the jaws 36 and 37 and the liners 65 can then be easily aligned with the mast deck bushing 53. Although engaged by the jaws 36 and 37 as well as the liners 65, the pipe 38 can be slid over the jaws 36 or 37 as well as the liners 65 while joints are assembled or disassembled.

It will be appreciated during the foregoing description of operation of the pipe positioner 24 that only the activation of the hydraulic cylinders 27, 28 and 34 is required. This arrangement lends itself to a simple control system. The stops 62 and limit switches will be employed in conjunction with a single electro-hydraulic control located in the operator's control panel. Activation of this control to an "in" position will cause the pipe positioner to move into position against these stops 62. A sequence valve will activate the cylinder 34 to cause the slidable jaws 36 and 37 to move to an inward position with the drill pipe while the pipe joints are assembled or disassembled. When the control is moved to an "out" position the above sequence will be reversed. Accordingly the sliding jaws 36 and 37 will move out releasing the drill pipe, the sequence valve will shift and the pipe positioner will be moved back to a stored position in the mast.

Hydraulic cylinders are the preferred actuating means for telescoping the frame as well as moving the jaws. Other actuating means such as hydraulic screw members or motor driven actuation devices could be used. While the linear 65 are advantageously used to accommodate different drill pipe diameters, these could be eliminated and a different arcuate frame to accommodate different drill diameter utilized with each drill pipe. The advantages of the drill pipe positioner would still be accomplished.

From the foregoing description it will be appreciated that the pipe positioner results in a unit which is less costly to produce, is relatively small in size and lends itself to ease of control. Reduction of cost is accomplished in the components which are employed and very little machining is required in fabrication. The size of the pipe positioner allows the drill operator a maximum view of the drilling operation while the pipe positioner is in stored position. As the positioner employs relatively few component parts which are actuated, a single control and a sequence valve can be employed resulting in a semiautomatic operation reducing operator error.

I claim:

1. A pipe positioner for holding and positioning drill pipe in an earth drilling machine during drilling wherein a mast is of the tilting type and said pipe positioner is adapted to be activated during an angle drilling operation, comprising:

a frame member adapted to support jaw engaging means for drill pipe, said jaw engaging means including an open portion positioned in a direction toward said mast with slide bar members operatively positioned in a guide frame member and fluid powered means to actuate said jaw engaging means from a pipe engaging position to a non-engaging position;

frame member activating means secured to said mast of said earth drilling machine above the mast deck, said frame member activating means constructed and arranged to provide a linear inward and outward movement of said frame member with respect to said mast above said mast deck with said open portion of said jaw engaging means facing said mast as said frame member is moved in the direction of said mast, said frame member activating means defined by inner and outer telescoping tubular members and hydraulic cylinder means connected to one of said telescoping tubular members.

2. The pipe positioner of claim 1 wherein said guide frame member is of a generally triangular configuration and includes guide surfaces for said slide bar members to guide said bar members in a converging guide path.

3. The pipe positioner of claim 2 wherein said fluid powered means to move said jaw engaging means is a double acting hydraulic cylinder and includes pivoted linkage means operatively connected to said cylinder and said slide bar members.

4. The pipe positioner of claim 3 wherein said pivoted linkage means is defined by pivot arms connected to a cylinder movable member at one end and a bracket member at the other end with said pivot arms also connected to said slide bar members.

5. The pipe positioner of claim 1 further including means connected to said frame member to activate said fluid powered means by means of movement of said frame member.

* * * * *